United States Patent [19]

Faulkner et al.

[11] Patent Number: 4,521,715

[45] Date of Patent: Jun. 4, 1985

[54] PHOTOEMISSIVE CATHODE FORMED ON CONDUCTIVE STRIPS

[75] Inventors: Richard D. Faulkner; Arthur F. McDonie, both of Lancaster, Pa.

[73] Assignee: RCA Corporation, Princeton, N.J.

[21] Appl. No.: 412,901

[22] Filed: Aug. 30, 1982

[51] Int. Cl.[3] ..... H01J 40/06

[52] U.S. Cl. ..... 313/531; 313/541

[58] Field of Search ..... 313/529, 530, 531, 532, 313/537, 541, 542, 544, 293, 294

[56] References Cited

U.S. PATENT DOCUMENTS

| | | | |
|---|---|---|---|
| 2,752,519 | 6/1956 | Ruedy | 313/530 X |
| 3,246,200 | 4/1966 | Kanter | 315/94 |
| 3,294,975 | 12/1966 | Fleck | 313/531 X |
| 3,368,077 | 2/1968 | Kazan | 313/530 X |
| 3,697,795 | 10/1972 | Braun et al. | 313/530 |
| 4,112,325 | 9/1978 | Faulkner | 313/532 |

*Primary Examiner*—Palmer Demeo
*Assistant Examiner*—Sandra L. O'Shea
*Attorney, Agent, or Firm*—Eugene M. Whitacre; Dennis H. Irlbeck; Vincent J. Coughlin, Jr.

[57] ABSTRACT

An electron tube having an evacuated envelope includes therein an insulating substrate with a photoemissive cathode thereon. The cathode comprises a plurality of discrete substantially isolated photoemissive regions. A plurality of spaced apart conductive strips are disposed on the substrate and interconnect each of the photoemissive regions.

5 Claims, 3 Drawing Figures

PHOTOEMISSIVE CATHODE FORMED ON CONDUCTIVE STRIPS

The present invention relates to a photoemissive cathode for an electron tube, and more particularly to a photoemissive cathode disposed on an insulating substrate wherein the photoemissive cathode comprises a plurality of discrete, substantially isolated photoemissive regions which are interconnected by a plurality of conductive strips.

U.S. Pat. No. 3,023,131 issued to Cassman on Feb. 27, 1962 discloses a photoemissive surface for a pickup tube which is formed as a photoemissive mosaic i.e., a plurality of photoemissive regions. In the Cassman pickup tube, a metal mesh is mounted to press against the surface of a support. A conductive signal electrode is disposed on the support and antimony is deposited thereon. The mesh serves as a stencil during the formation of the mosaic elements. A small quantity of an alkali metal, such as sodium, is deposited onto the antimony. The mesh is then withdrawn from the support and additional alkali metals are subsequently introduced onto the antimony-sodium surface to produce a photoemissive surface comprising a mosaic structure. The signal electrode is a substantially transparent conductive film disposed on the insulating support to provide a conductive substrate on which to form the photoemissive surface. Such a signal plate is frequently formed by evaporating a layer of nickel or chromium onto a glass substrate. One problem with such a signal plate is that to achieve sufficient conductivity, the thickness of the film is such that the transmission of the film is attenuated, thereby decreasing the amount of light passing through the glass substrate into the photoemissive surface, and reducing the quantum efficiency of the photoemitter.

U.S. Pat. No. 3,697,794 issued to Stoudenheimer et al., on Oct. 10, 1972 discloses a photocathode structure comprising a substrate of tin oxide having thereon an alkali-antinomide photoemissive coating with a layer of antimony oxide interposed between the tin oxide substrate and the photoemissive coating. In the Stoudenheimer et al. patent, the photoemissive surface is not comprised of a mosaic of individual photoemissive regions, but comprises a single photoemitter. Tin oxide is preferred over metal films such as nickel and chromium because tin oxide is the only known conductive material that posseses sufficient lateral conductivity when applied to a thinness for acceptable light transmission. However, as disclosed in the Stoudenheimer et al. patent, tin oxide poisons conventional alkali-antinomide cathodes; therefore, a protective interface of antimony oxide is required between the tin oxide and the photoemissive surface. The Stoudenheimer et al. patent discloses a complicated and costly process for building-up multiple layers of antimony oxide over the tin oxide conductive layer. Such a complicated and costly process is undesirable, and a simple, low cost structure for providing a highly transmissive, conductive substrate for a mosaic photoemissive surface is required.

While it is known in the art to build-up multiple antimony oxide layers on the tin oxide coated interior faceplate surface of a photomultiplier envelope during the photoemissive cathode formation process, by the procedure of repeated deposition and oxidation of antimony films, such a procedure cannot be utilized in tubes having an accelerating mesh electrode in close proximity to the photocathode since the mesh elements would shadow portions of the tin oxide coating from the antimony film deposition and thus permit poisoning of the subsequently formed photoemissive cathode.

SUMMARY OF THE INVENTION

An electron tube having an evacuated envelope includes therein an insulating substrate with a photoemissive cathode thereon. The cathode comprises a plurality of discrete, substantially isolated photoemissive regions. A plurality of spaced apart conductive strips are disposed on the substrate and interconnect each of the photoemissive regions.

DETAILED DESCRIPTION OF THE PREFERRED EMBODIMENT

Figure 1:
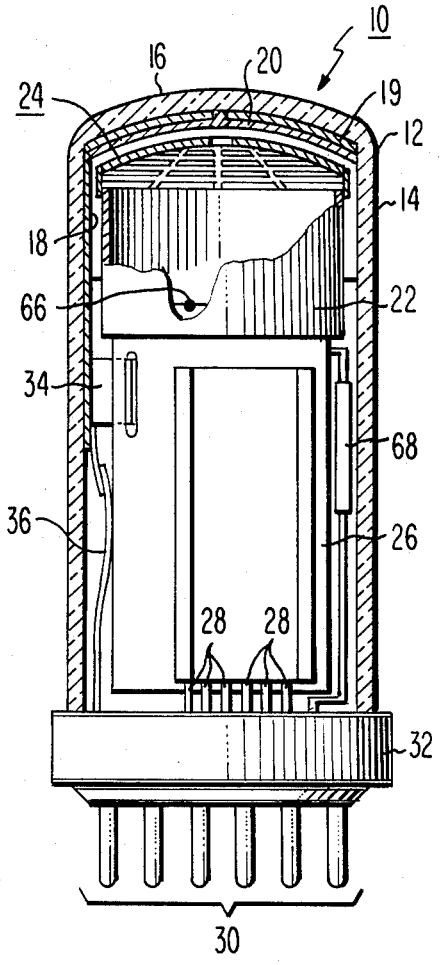
FIG. 1 is a partially cut-away side view of a photomultiplier tube in which the present invention is incorporated.

Referring to FIG. 1, there is shown a photomultiplier tube 10 comprising an evacuated glass envelope 12 having a generally cylindrical sidewall 14 and a transparent faceplate 16. An aluminized coating 18 is disposed on an interior surface portion of the sidewall 14 adjacent to the faceplate 16. The coating 18 electrically contacts a plurality of conductive strips 19 that are disposed on the interior surface of the faceplate 16. Within the tube 10 is a photoemissive cathode or photocathode 20. The photocathode 20 overlies the conductive strips 19 and is in contact with the coating 18 on the sidewall 14. The photocathode 20 may be potassium-cesium-antimonide, for example, or any one of a number of photoemissive materials well known in the art. The photocathode 20 provides photoelectrons in response to radiation incident thereon.

The tube is provided with a cup-shaped electrode 22, which terminates in a substantially flat base portion having an aperture (not shown) therein. A mesh electrode 24 is attached to the open end of the cup-shaped electrode 22. The mesh electrode 24 is disposed adjacent to the photocathode 20 and is spaced therefrom. The mesh electrode 24 provides a substantially uniform electric field adjacent to the photocathode 20 to substantially equalize the center-to-edge transit time difference for photoelectrons from the photocathode 20. The electrode 22 is supported by a pair of support insulators 26, (only one of which is shown). The insulators 26 may comprise a material such as ceramic that has high mechanical strength.

An electron multiplier (not shown), comprising a primary dynode, a plurality of secondary dynodes and an anode, is disposed between the support insulators 26. A plurality of conductive lead members 28 (only some of which are shown) extend between the electrode 22, the dynodes, the anode, and a plurality of terminals 30 in a base 32 attached to the tube 10.

Electrical connection to the photocathode 20 is provided by a contact member 34 which is in pressure contact with a projection of the aluminized coating 18. A cathode lead 36 is attached at one end to the contact member 34 and at the other end to one of the terminals 30 in the base 32. Electrical potentials are applied to the various tube elements from an external source (not shown) through the terminals 30.

Figure 2:
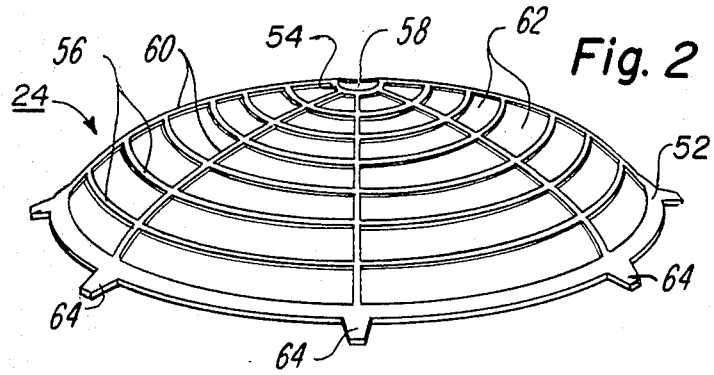
FIG. 2 is an enlarged perspective view of the mesh electrode shown in FIG. 1.

With the exception of the mesh electrode 24, the tube 10 is similar to the tube structure disclosed in U.S. Pat. No. 4,431,943 issued to Faulkner et al. on Feb. 14, 1984. The mesh electrode structure 24 is described in U.S. Pat. No. 4,456,852 issued to Faulkner et al. on June 26, 1984. The above-referenced patent applications are assigned to the assignee of the present invention, and are incorporated herein for the purpose of disclosure. Briefly, the mesh electrode 24, as shown in FIG. 2, includes a peripheral support ring 52, an innermost mesh ring 54, and a plurality of substantially concentric intermediate mesh rings 56 of progressively decreasing diameter disposed between the peripheral support ring 52 and the innermost mesh ring 54. The innermost mesh ring 54 circumscribes a central aperture 58. The mesh rings are spaced apart to permit photoelectrons from the photoemissive cathode 20 to pass between the adjacent rings of the mesh electrode 24.

A plurality of support members 60 extend generally radially inwardly from the peripheral support ring 52 and terminate at the innermost mesh ring 54. The support members 60 intersect the intermediate rings 56 that are disposed between the peripheral support ring 52 and the innermost mesh ring 54 to form, with the intersected mesh rings 56, a plurality of arcuately-shaped apertures 62. A plurality of mounting tabs 64 are provided around the outer periphery of the support ring 52 to facilitate attaching the mesh electrode structure 24 to the electrode 22. The mesh electrode 24 is shown to have a domed-shape which closely conforms to the curvature of the interior surface of the faceplate 16; even if the interior surface of the faceplate were flat, a domed-shaped mesh electrode would be used for focusing.

Disposed within the electrode 22 are a plurality of platinum-antimony beads 66 (only one of which is shown) for evaporating antimony onto the interior surface of the faceplate 16 during the formation of the photocathode 20. The mesh rings 52, 54, 56 and the support members 60 of the mesh electrode 24 are disposed between the platinum-antimony beads 66 and the faceplate 16, and intercept some of the evaporated antimony so that the antimony that is deposited on the faceplate 16 passes through the apertures 58,62 to form a pattern comprising a plurality of discrete, isolated antimony regions (not shown) on the interior surface of the faceplate 16. The antimony regions are activated by one or more alkali metals, contained within a conventional retainer 68, to form discrete, substantially electrically isolated alkali-antinomide photoemissive regions (not shown). The formation of an alkali-antinomide photocathode is described in U.S. Pat. No. 4,311,939 issued to Faulkner, et al. on Jan. 19, 1982 and incorporated by reference herein for disclosure purpose.

In order to ensure that each of the discrete photoemissive regions of the photocathode 20 are electrically interconnected, a pattern of conductive strips 19 is disposed on the interior surface of the faceplate 16. The strips 19 preferably comprise a thin aluminum film; however, other metals, including nickel, chromium, and silver, may be used. The list is not meant to be limiting and any metal that is compatible with the alkali metals used to form the photocathode 20, that adhers well to the glass faceplate, and that can be readily evaporated onto the faceplate may be utilized.

Figure 3:
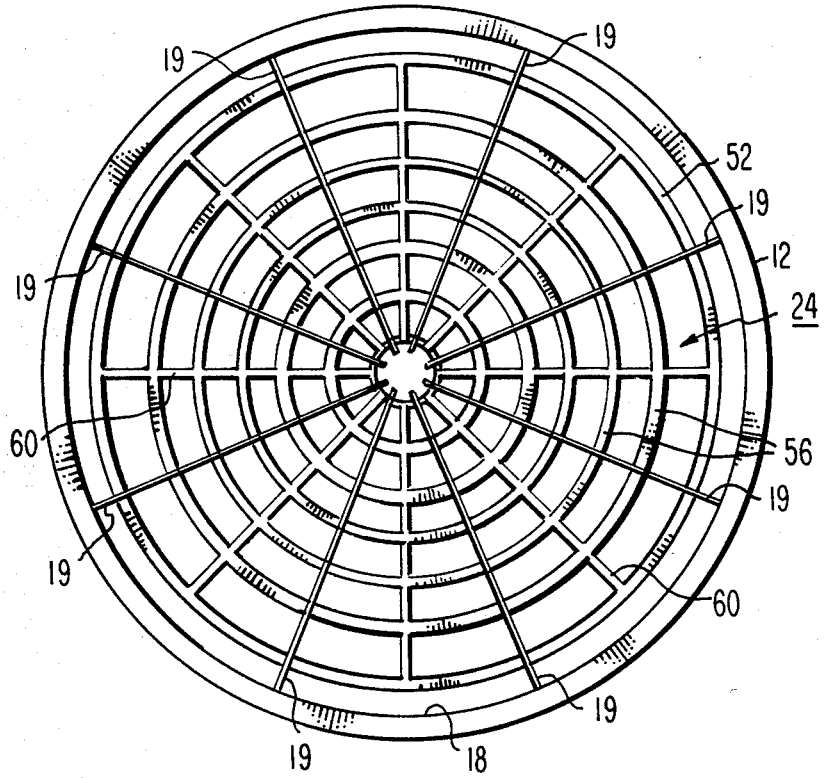
FIG. 3 is an enlarged plan view of the tube of FIG. 1 showing the orientation of the novel conductive strips on the faceplate interior surface relative to the mesh electrode.

The strips 19 may be formed at the same time the aluminized coating is deposited on the sidewall 14 of the envelope 12. In order to aluminize the sidewall 14, the envelope 12 is placed in a vacuum chamber (not shown) containing a charge of aluminum and means for heating the aluminum to evaporation. The interior surface of the envelope that is to be free of the aluminum film is masked to prevent the deposition of aluminum. The faceplate mask includes a plurality of thin slits through which the evaporated aluminum can pass to form the pattern of strips 19 on the faceplate 16. The method of evaporating a thin film of aluminum is conventional and need not be described. Since the pulsed photocathode current is of the order of only 12 nanoamperes, the strips 19 may be relatively thin in order to maximize the transmission of light through the faceplate 16 and into the photocathode 20 while still providing sufficient conductivity to the discrete photoemissive regions. The radially extending conductive strips 19 having a width of about 0.5 millimeter and a thickness of between 300 Angstrom units to about 1000 Angstrom units. The radial conductive strip pattern is selected, in this instance, to provide a structure that can most efficiently contact each of the discrete photoemissive regions formed as a result of the evaporation of the photocathode forming materials through the mesh electrode 24. The faceplate 16, having the conductive strip pattern formed thereon, has a transmission to visible light at about 97 percent, and values as high as 99 percent have been obtained. The envelope 12 is oriented with respect to the mesh electrode 24 so that the strips 19 on the interior surface of the faceplate 16 are oriented between the support members 60 of the mesh electrode 24. Such an orientation is shown in FIG. 3. This orientation assures that each of the photoemissive regions of the photocathode 20 overlies at least one of the strips 19. To maximize the light transmission throught the faceplate 16, the strips 19 do not converge at the center of the faceplate but extend only far enough towards the center of the faceplate to contact the centermost photoemissive region of the photocathode 20.

What is claimed is:

1. In an electron tube having an evacuated envelope including a transparent faceplate with an interior surface with a photoemissive cathode thereon, said cathode comprising a plurality of discrete, substantially isolated photoemissive regions, wherein the improvement comprises a plurality of spaced apart conductive strips disposed on said interior surface of said faceplate, each of said conductive strips contacting several of said plurality of photoemissive regions and electrically interconnecting all of said plurality of photoemissive regions.

2. In a photomultiplier tube comprising an evacuated envelope having a transparent faceplate with an interior surface, a mesh electrode having a plurality of apertures therethrough disposed adjacent to said interior surface and spaced therefrom, processing means within said tube for forming a photoemissive cathode by evaporating suitable materials through the apertures in said mesh electrode, said cathode comprising a plurality of discrete, substantially isolated photoemissive regions disposed on said interior surface, wherein the improvement comprises a plurality of spaced apart conductive strips physically connected to one another and disposed on the interior surface of said faceplate, said strips being located such that each of said photoemissive regions overlies at least one of said strips, thereby electrically interconnecting each of said discrete, substantially isolated photoemissive regions.

3. The tube as described in claim 2, wherein said conductive strips extend radially inwardly from a conductive coating on said envelope adjacent to said faceplate.

4. The tube as described in claim 2, wherein said faceplate having said conductive strips disposed on the interior surface thereof has a transmission to visible light of about 97 percent.

5. In a photomultiplier tube comprising:

an evacuated envelope having a transparent faceplate with an interior surface;

a mesh electrode having a central aperture and a plurality of substantially arcuately shaped apertures disposed thereabout, said mesh electrode being disposed adjacent to said interior surface of said faceplate and spaced therefrom, said mesh electrode comprising a peripheral support ring, an innermost mesh ring, and a plurality of substantially concentric, spaced apart intermediate mesh rings of decreasing diameter disposed substantially within said peripheral support ring, said mesh electrode further including a plurality of support members extending generally radially inwardly from said peripheral support ring and terminating at the innermost mesh ring, said support members intersecting said intermediate mesh rings to form said substantially arcuately shaped apertures;

processing means within said tube for forming a photoemissive cathode by evaporating suitable materials through said apertures in said mesh electrode onto said interior surface of said faceplate, said cathode comprising a plurality of discrete, substantially isolated photoemissive regions including a central region surrounded by a plurality of substantially arcuately shaped regions, wherein the improvement comprises:

a plurality of spaced apart aluminum strips disposed on the interior surface of said faceplate and extending radially inwardly from an aluminized coating adjacent to the faceplate, said strips being oriented between the support members of the mesh electrode so that each of said photoemissive regions, formed by evaporating materials through the apertures in said mesh electrode, overlies at least one of said strips, thereby interconnecting each of said discrete, substantially isolated photoemissive regions.

* * * * *